US005814579A

United States Patent [19]

Dotson et al.

[11] Patent Number: 5,814,579

[45] Date of Patent: Sep. 29, 1998

[54] MULTICOLOR PRINTING SYSTEM

[75] Inventors: Mark D. Dotson, Dayton; William J. Castle, Hilliard, both of Ohio; Bryan A. Netsch, Lewisville, Tex.

[73] Assignee: The Standard Register Company, Dayton, Ohio

[21] Appl. No.: 689,221

[22] Filed: Aug. 6, 1996

[51] Int. Cl.[6] ..... B41M 5/132; B41M 5/165

[52] U.S. Cl. ..... 503/201; 503/213; 503/217; 427/145; 427/337; 106/31.16; 106/31.19

[58] Field of Search ..... 427/145, 256, 427/333, 337; 503/201, 213, 217; 106/31.33, 31.16, 31.19

[56] References Cited

U.S. PATENT DOCUMENTS

| | | | |
|---|---|---|---|
| 3,836,382 | 9/1974 | Garner et al. | 117/36.2 |
| 4,212,393 | 7/1980 | Lenkoff | 206/575 |
| 4,303,719 | 12/1981 | Vassiliades | 428/207 |
| 4,411,450 | 10/1983 | Petitpierre | 282/27.5 |
| 4,453,744 | 6/1984 | Würmli et al. | 346/216 |
| 4,514,177 | 4/1985 | Lenkoff | 434/328 |
| 4,562,116 | 12/1985 | Okada et al. | 428/402.21 |
| 4,574,110 | 3/1986 | Asano et al. | 428/402.21 |
| 4,586,714 | 5/1986 | Lenkoff et al. | 273/157 R |
| 4,670,344 | 6/1987 | Okada et al. | 428/402.21 |
| 4,680,598 | 7/1987 | Obitsu et al. | 503/217 |
| 4,716,424 | 12/1987 | Petitpierre et al. | 503/210 |
| 4,717,710 | 1/1988 | Shimizu et al. | 503/213 |
| 5,160,266 | 11/1992 | Landis | 434/328 |
| 5,217,231 | 6/1993 | Landis | 273/429 |
| 5,232,494 | 8/1993 | Miller | 106/22 B |
| 5,234,344 | 8/1993 | Lenkoff | 434/84 |
| 5,250,492 | 10/1993 | Dotson et al. | 503/201 |
| 5,254,522 | 10/1993 | Zink et al. | 503/217 |
| 5,326,388 | 7/1994 | Miller et al. | 106/22 B |
| 5,485,792 | 1/1996 | Keyser et al. | 106/21 R |
| 5,498,282 | 3/1996 | Miller et al. | 106/22 B |
| 5,503,665 | 4/1996 | Miller et al. | 106/21 R |

*Primary Examiner*—Shrive Beck
*Assistant Examiner*—Fred J. Parker
*Attorney, Agent, or Firm*—Luedeka, Neely & Graham, P.C.

[57] ABSTRACT

The invention described in the specification relates to latent image printing and developing systems and to substrates containing latent images. High quality latent images are prepared by a printing method which deposits a layer containing organic-based dye particles and organic-based developer particles, each having a particle size of from about 2 to about 6 microns, on a substrate. The image is then developed by contacting the substantially invisible image of dye and developer particles with an oxygenated solvent from an imaging device. Multicolor, vivid images are obtained as a result of the image printing and developing system of the invention.

39 Claims, 1 Drawing Sheet

MULTICOLOR PRINTING SYSTEM

FIELD OF THE INVENTION

This invention relates to multicolor novelty printed products, image developer systems for the products and to methods for developing latent images on a substrate containing substantially invisible images.

BACKGROUND OF THE INVENTION

Substrates containing latent images have been used in the business forms market for producing security documents. The components used to develop images for the business forms are often self-contained in the forms typically by using microcapsules which are rupturable upon impact or contact with a suitable solvent. One such self-contained coating is described in U.S. Pat. No. 5,250,492 to Dotson et al. which relates to carbonless coating compositions for use with business forms or mailers. The business forms described by Dotson et al. are made using an admixture of a color former, a color developer, and a plurality of pressure-rupturable microcapsules containing solvent. A latent image printed with the admixture becomes visible upon application of pressure or solvent to the coated area to rupture or dissolve the microcapsules so that the solvent in the microcapsules interacts with the color developers and color formers in the coating. While the methods and compositions of Dotson et al. are particularly suitable for business forms, they are not particularly suitable for preparing games and novelty products which contain hidden or latent multicolor images. Inadvertent rupture of the microcapsules containing solvent may result in image development particularly in unintended areas of the form while handling or shipping the form. Furthermore, it is difficult and expensive to prepare multi-color latent images of the density required for novelty products using microcapsule technology. Accordingly, improvements in hidden image technology are required to achieve the desired level of reliability and image sharpness and to reduce the expense and production difficulty of multi-color latent image products for the novelty and game markets.

Another latent image development system is described in U.S. Pat. No. 5,485,792 to Keyser et al. In this system described by Keyser et al., the color developer is dissolved in a water-based solvent so that when it contacts a substrate containing a color former, it will react with a color former on a substrate to develop an image. Keyser et al. require the color former be dissolved in a suitable volatile or mineral oil ink solvent for printing on a substrate. Accordingly, the application of such systems is limited to color developers which are water soluble and to solvent printing systems for producing and developing latent images on substrates.

An object of the invention is to provide improved novelty stationary and game pieces containing hidden images.

Another object of the invention is to improve the methods for printing a hidden image on a substrate.

A further object of the invention is to provide a substrate containing multiple, hidden colored images which may be revealed and/or concealed as desired by application of a suitable solvent.

Another object of the invention is to provide a method for developing relatively sharp, multi-colored images on a substrate preprinted with a latent image.

SUMMARY OF THE INVENTION

With regard to the foregoing and other objects and advantages of the invention, the present invention provides a printed substrate and latent image development system for use in the novelty product market. According to one aspect, the present invention provides a method for developing an image on a substrate which comprises providing a dispersion of organic-based dye particles having an average particle size of from about 2 to about 6 microns and organic-based developer particles having average particle size of from about 2 to about 6 microns in an aqueous carrier fluid. The dispersion is printed on a substrate so that a substantially invisible image or latent image is produced. The printed substrate is then contacted with an imaging device containing an oxygenated solvent to develop a visible image on the substrate from the substantially invisible image.

Novelty products made by the methods of the present invention comprise a printed substrate having a layer composed of a mixture of organic-based dye particles having an average particle size of from about 2 to about 6 microns and organic-based developer particles having average particle size of from about 2 to about 6 microns and an imaging device containing an oxygenated solvent.

Another aspect of the invention provides a method for developing an image on a substrate which comprises dispersing an organic-based dye having an average particle size of from about 2 to about 6 microns in an aqueous carrier fluid, depositing the dispersion on a substrate so that a substantially invisible image is produced and contacting at least a portion of the substrate with an imaging device containing an oxygenated solvent and an organic-based developer in an amount sufficient to develop a visible image on the substrate from the substantially invisible image thereon.

A further aspect of the invention provides a method for developing an image on a substrate which comprises dispersing an organic-based developer having an average particle size of from about 2 to about 6 microns in an aqueous carrier fluid, printing the dispersed developer on a substrate to provide a substantially invisible image and contacting at least a portion of the printed substrate with a device containing an oxygenated solvent and an organic-based dye in an amount sufficient to develop a visible image on the substrate.

Unlike many of the carbonless business forms and hidden image systems used for detecting altered or counterfeit documents, the products of the present invention do not require the preparation and use of microcapsules for any of the color components, developers or solvents. Hence, the production of the coated substrate is simpler and requires fewer process steps.

The images developed on substrates produced by the foregoing process are more intense than images produced using microcapsule technology because the particle size for the color developer and color former may be smaller than the microcapsules thereby allowing greater particle density on the coated substrate. Hence, the latent image product of the invention is more suitable for games or novelty art works than products containing microencapsulated components.

Improvements in the solvent system for contacting a substrate containing organic-based dyes and organic-based color developers have also led to improvements in the activation and development of visible images from initially invisible or hidden images. Because the solvent used to activate the organic-based dyes and organic-based color developers need not be self-contained in the substrate there is substantially more flexibility in the selection of substrates and solvents which may be used.

BRIEF DESCRIPTION OF THE DRAWINGS

The above and other features of the invention will now be further described in the following detailed specification in conjunction with the accompanying drawings in which.

DETAILED DESCRIPTION OF THE PREFERRED EMBODIMENTS

In the methods of the present invention, a layer containing organic-based dye particles and organic-based developer particles is deposited or printed on a substrate, preferably as a latent or substantially invisible image. By "substantially invisible" means that the deposited area may have a slight discoloration or may vary in tint from the adjacent substrate, however, to the casual observer, the variation in tint or coloration is so slight as to be essentially imperceptible prior to developing the image with an imaging device.

Figure 1:
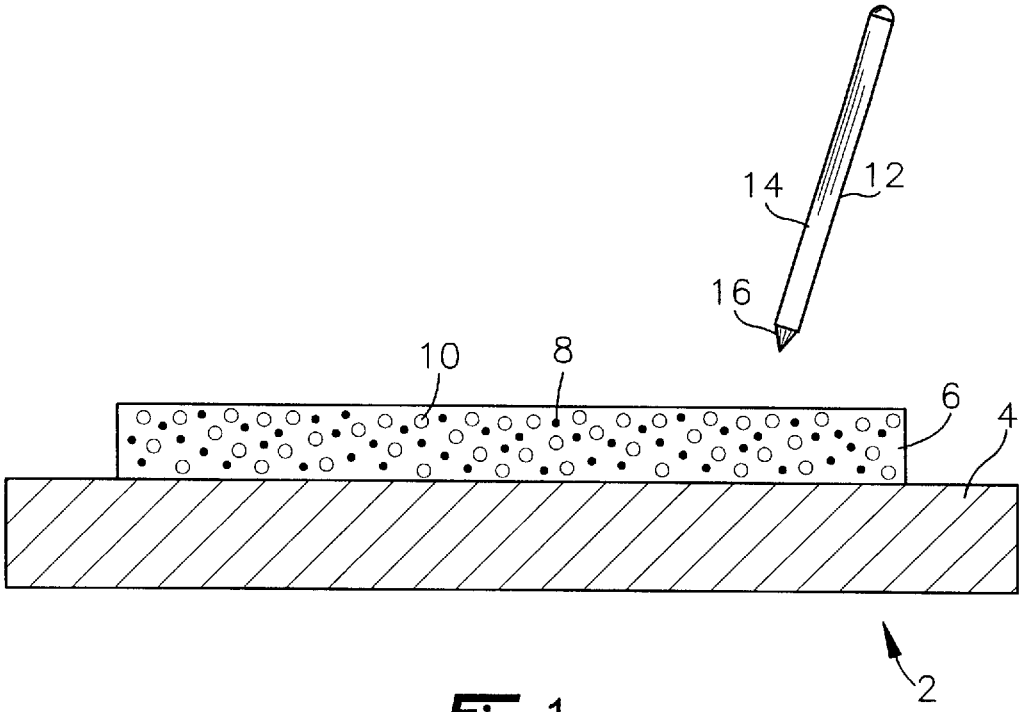
FIG. 1 is a cross-sectional side view of printed substrate and imaging device of the invention.
Figure 2:
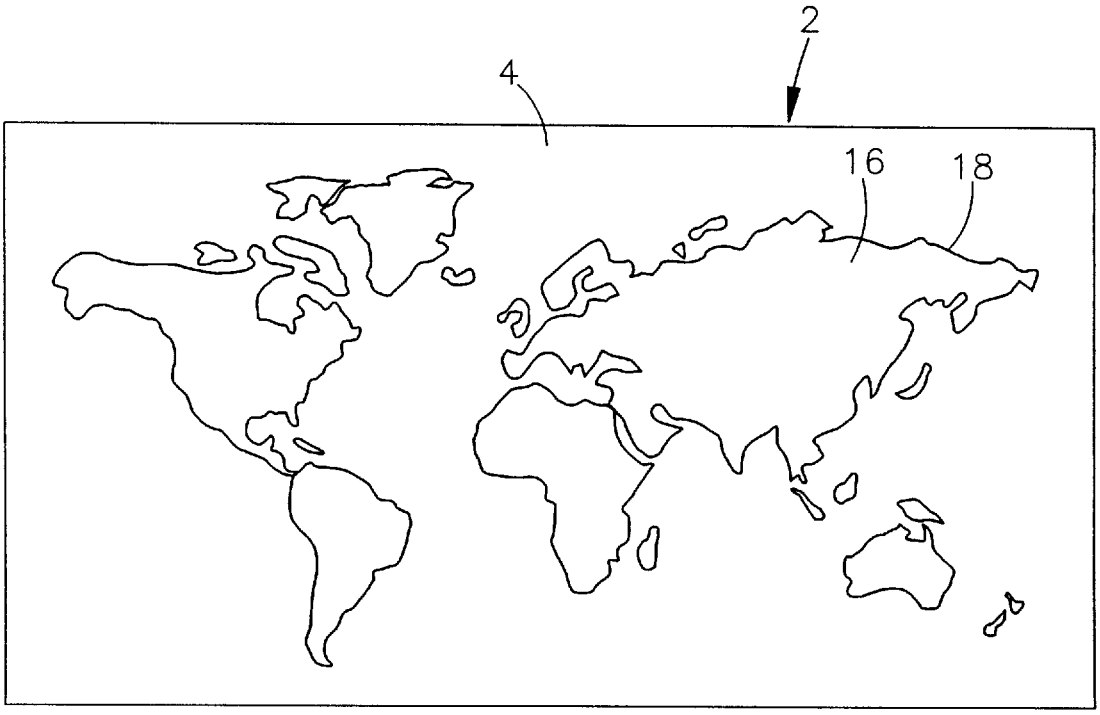
FIG. 2 is a plan view of a substrate printed with hidden images according to the invention.

With reference to FIGS. 1 and 2, there is shown a printed novelty product 2 of the invention made in accordance with the present invention and an imaging device 12 for developing the image. The novelty product 2 includes a substrate 4 and a layer 6 containing a mixture of organic-based dye particles 8 and organic-based color developer particles 10 bound to the substrate 4 with a suitable binder (not shown). The layer 6 may be substantially continuous over the entire substrate 4 or cover only a portion of the substrate 4 as shown in the outline portions 18 of FIG. 2. When an imaging device 12 such as a pen containing a suitable solvent is contacted with the printed layer 6, images become visible in the areas of solvent contact.

Without desiring to be bound by theoretical considerations it is believed that the organic-based dye 8 and organic-based color developer particles 10 are resistant to reaction with one another, even without use of a stabilizer, and that the solvent causes the individual particles to react with one another so that a visible color image is obtained. Because the layer 6 is substantially free of solvent, very little premature reaction takes place between the organic-based color developer 10 and organic-based dye particles 8 thereby preserving the substantially invisible nature of the image despite intimate mixing of dye and developer in the coated layer.

An important feature of the invention is the nature and characteristics of the printed layer 6. In order to print an image which exhibits improved contrast and vividness once developed, it is preferred to first grind organic-based dye particles 8 and organic-based color developer particles 10 to an average particle size ranging from about 2 to about 6 microns, preferably an average particle size of about 4 microns. Grinding of the particles may be accomplished by using any number of conventional methods and devices commonly used in the art such as a horizontal mill, hammer mill, attrition mill, ball mill, pebble mill, rod mill, tube mill, ring roller mill, compartment mill and the like. The preferred method for grinding the particles is by use of a horizontal mill. A dispersant, such as SURFYNOL GA commercially available from Air Products and Chemicals, Inc. of Allentown, Pa. is preferably used during the grinding step for the dye and developer particles. The amount of dispersant used during the grinding step is about 3% by weight based on the weight of dry particles.

A wide variety of organic-based color developers 10 may be used in the printed layer 6 of the present invention. Suitable organic-based color developers 10 include unsubstituted or ring-substituted phenols, phenolic resins, sulfone compounds, alkylhydroxybenzoic acid compounds and salicylic acid or salicylate and their metal salts. A most preferred organic-based color developer 10 is 25 wt. % 4,4-sulfonyldiphenol. When an acidic developer is used it is preferred to dissolve the color developer in a solvent in the imaging device 12 rather than coating the substrate with a mixture of dye and developer.

Likewise, a wide variety of organic-based dyes 8 may be used for preparing the printed layer 6. Suitable organic-based dyes 8 include crystal violet lactone, p-toluenesulfonate salt of Michler's hydrol, indolyl red, malachite green lactone, spiro phthalide xanthenes, 3-cyclohexyl-methyl-amino-6-methyl-7-anilino fluoran and the like. Preferred organic-based dyes 8 include, but are not limited to, CIBA I2G (blue), CIBA I6B (red), YAMADA Y721 (yellow), CIBA IG (orange) and YAMADA 305 (black). The CIBA dyes are commercially available from Ciba-Geigy Corporation of Hawthorne, N.Y. and the YAMADA dyes are commercially available from Nagase America of New York, N.Y.

Regardless of the particular organic-based dye 8 or organic-based color developer 10 selected for preparing the layer 6 according to the invention, it is important that there be little or no reaction between the organic-based dye 8 and organic-based color developer 10 particles during the deposition or printing step used to prepare the layer 6 on a substrate 4. Accordingly, once ground to the desired particle size, the organic-based dye 8 and organic-based color developer 10 particles are thoroughly mixed and dispersed in an aqueous carrier fluid which is selected based on its inability to dissolve the organic-based dye and developer particles. An aqueous carrier fluid is preferred so that the dye 8 and color developer 10 particles, being substantially organic, do not react with one another in the carrier to a degree sufficient to cause premature development of the image or discoloration of the substrate in the printed area. When the dye and developer are premixed for coating onto a substrate it is preferred to use a developer which is not an acidic compound in order to avoid premature color formation.

The ground organic-based dye 8 and organic-based color developer 10 particles may be combined with an aqueous carrier fluid to form a slurry for printing at any time prior to printing the mixture on the substrate 4. However, due to a minor amount of hydrolysis over time it is preferred to prepare the slurry containing the dye and developer just prior to printing the mixture. The slurry preferably contains from about 5 to about 15 wt % organic-based dye, from about 6 to about 30 wt % organic-based color developer and from about 20 to about 90 wt. % water.

Additional components may be present in the slurry including film formers, fillers, binders, waxes, non-volatile diluents, uv absorbers, antioxidants and 6 micron starch particles (stilt). Film formers, which may be used include polyvinyl pyrrolidone, polyvinyl alcohol, starch, grafted starch and the like. In addition, the film former provides excellent rheological properties to the slurry mixture which permit the image to be spot coated or printed using conventional flexographic printing equipment. The film former also aids in maintaining the organic-based dye 8 and organic-based color developer 10 particles at the surface of the substrate 4 so that solvent interaction with the organic-based dye 8 and organic-based color developer 10 particles produces a sharp image on the surface of the substrate.

The binders with are used to prepare the slurry compositions for printing a substrate with a latent image may be selected from partially or fully hydrolyzed polyvinyl alcohols, natural or modified starches, acrylics and the like. A preferred binder is a modified starch available under the trade name AQ-103 from EFA of Fairborn, Ohio.

Fillers which may be included in the slurry composition for printing may be selected from any number of compounds such as calcium carbonate, wheat starch, rice starch and the like. A preferred filler is 6 micron rice starch available from Remy Industries S.A. of Brussels, Belgium under the trade name REMYLINE AC.

Diluents may also be used to reduce the viscosity of the slurry for printing and to reduce curling of the coated substrate. Due to the printing methods and weight of coating printed on the substrate, it is preferred that the diluent be relatively non-volatile. Accordingly, a preferred diluent is a methyl glucocide commercially available from Grain Processing Corporation of Muscatine, Iowa under the tradename GEO-MEG 104.

A particularly preferred slurry composition for printing a substrate 4 using a flexographic printing process comprises from about 20 to about 40 wt. % water; from about 3 to about 15 wt. % organic-based dye; from about 8 to about 20 wt. % organic-based color developer; from about 30 to about 50 wt. % binder, from about 0 to about 5 wt. % film former, and from about 7 to about 15 wt. % filler.

The amount of slurry deposited or printed on a substrate 4 varies with the characteristics of the substrate 4 and the use for the novelty product 2. Higher coating weights may be used for more porous substrates, whereas lower coating weights may be acceptable for substantially non-porous substrates. For many substrates, it is desirable to apply a sub-layer between the substrate 4 and the deposited layer 6 in order to reduce the absorbance of the substrate 4 or reduce the contrast between the deposited layer 6 and the undeposited portions of the substrate 4 adjacent the deposited layer 6. Such sublayer may comprise a pigmented coating of ink such as an amine solubilized acrylic, overprint varnish or other material which substantially reduces the contrast between the substrate and the printed layer. A preferred sublayer is a starch-based coating containing $TiO_2$ or $CaCO_3$ plus an optical brightener such as CIBA TINOPAL SCP commercially available from Ciba-Geigy Corporation. It is preferred to use a sublayer which provides a difference in reflectance between the substrate and the deposited layer of less than about 5 percent.

The preferred coating weights of the layer printed on the substrate range from about 0.5 to about 3 pounds per 1300 square feet. Accordingly, the thickness of the layer 6 after drying ranges from about 0.5 micron to about 5 micron. The preferred thickness of the layer 6 is about 1 micron.

Before the slurry is deposited on a substrate 4, it may be desirable to coat the opposing surface of the substrate 4 with varnish or stiffening material to reduce substrate 4 curling particularly when the substrate 4 is a thin web such as paper or a plastic film. An example of a suitable varnish is WVG-000140 available from Water Inks Technology of Iron Station, N.C. under the trade name WATER LITHO.

Substrates which may be used for the novelty products of the invention include, but are not limited to, metal, wood, natural and synthetic cloth, ceramic and glass. Plastic substrates include polyester, polystyrene, polypropylene and the like. A preferred plastic substrate is polyester. Likewise, preferred paper substrates include offset, matte or coated papers. A preferred paper substrate is offset paper available from Boise Cascade of Kansas City, Mo. and has a weight of about 50 pounds per ream.

Once the slurry is deposited or printed on the substrate 4 the printed layer 6 is allowed to air dry at 25° C. from about 4 to about 8 hours or is oven-dried at a temperature of from about 65° C. to about 95° C. for from about 5 to about 10 seconds. A preferred method of drying with heat is to use a commercial convection oven.

In order to ensure that the slurry is distributed evenly on the substrate 4 during printing a dispersant may be used. Suitable dispersants include polyvinylacetate, gums, surfactants and the like.

Non-limiting examples of formulations which may be used to prepare latent image products according to the invention are now given.

Base Ink Formulation

| Ingredient | Composition (wt. %) |
|---|---|
| water | 23.8 to 32.7 |
| AQ-103 grafted starch (binder) | 45.4 |
| REMYLINE AC 6 micron starch particles (stilt) | 8.0 |
| GEO-MEG 04 methyl glucocide | 8.0 |
| IRGANOX[1] antioxidant | 1.7 |
| CARBOSET[2] 1915 acrylic resin | 0.68 |
| FOAM-X 1465[3] antifoam | 0.02 |
| TINUVIN P[4] uv adsorber | 1.7 |
| polyvinyl alcohol LL-603[5] solution | 1.6 |
| TINOPAL SCP | 0.02 |

[1]IRGANOX is an antioxidant commercially available from Ciba-Geigy Corporation of Hawthorne, New York.
[2]CARBOSET 1915 is a proprietary acrylic resin commercially available from Standard Register Company of Dayton, Ohio.
[3]FOAM-X 1465 is a proprietary antifoam agent commercially available from Standard Register Company of Dayton, Ohio.
[4]TINUVIN P and PST are uv absorbers commercially available from Ciba-Geigy Corporation of Hawthorne, New York.
[5]LL-603 is a cold water soluble polyvinyl alcohol commercially available from Pluess-Stauffer, International of Stanford, Connecticut.

Red Dye Formula

| Ingredient | Composition (wt. %) |
|---|---|
| CARBOSET 1915 acrylic resin | 1.35 |
| water | 4.4 |
| FOAM-X antifoam | 0.03 |
| polyacrylic | 0.105 |
| SURFYNOL GA surfactant | 0.12 |
| CIBA IBG dye (red) | 3.0 |
| CIBA ORANGE IG dye | 3.0 |
| Base Ink Formulation (from above table) | 88.0 |

Blue Dye Formula

| Ingredient | Composition (wt. %) |
|---|---|
| polyvinyl alcohol LL 603 solution | 0.144 |
| water | 5.5 |
| SURFYNOL GA surfactant | 0.3 |
| CIBA IGB dye (blue) | 6.0 |
| Base Ink Formulation (from above table) | 88.0 |

Yellow Dye Formula

| Ingredient | Composition (wt. %) |
|---|---|
| CARBOSET 1915 acrylic resin | 1.5 |
| water | 37.25 |
| FOAM-X antifoam | 0.03 |
| YAMADA Y 721 dye (yellow) | 6.0 |
| Base Ink Formulation (from above table) | 88.0 |

Green Dye Formula

| Ingredient | Composition (wt. %) |
|---|---|
| CARBOSET 1915 acrylic resin | 1.25 |
| water | 5.51 |
| FOAM-X antifoam | 0.025 |
| polyvinyl alcohol LL 603 | 0.24 |
| SURFYNOL GA surfactant | 0.06 |
| YAMADA Y721 dye (yellow) | 5.0 |
| CIBA 12G dye (blue) | 1.0 |
| Base Ink Formulation (from above table) | 88.0 |

Orange Dye Formula

| Ingredient | Composition (wt. %) |
|---|---|
| CARBOSET 1915 acrylic resin | 1.5 |
| water | 4.47 |
| FOAM-X antifoam | 0.03 |
| CIBA IG dye (orange) | 6.0 |
| Base Ink Formulation (from above table) | 88.0 |

Each of the above dye formulations is a press ready formulation. The formulations may be spot printed on a paper substrate using a COMPCO COMAMANDER printer with 10–11 billionths of a cubic meter (BCM), 200 line anilox rolls with a doctor blade. Other printing techniques may also be used to obtain the latent image products according to the invention and the amount of base ink to dye may be adjusted for lower or higher BCM anilox rolls.

In order to develop an image on a substrate coated with a dispersion containing only dye, a developer, such as 4,4-sulfonyldiphenol is dissolved in a suitable solvent and applied to the coated substrate in the desired areas. Preparation of a coating which may include both dye and developer and which is sensitive to solvent and abrasion is given in the following tables.

Developer Dispersion

| Ingredient | Composition (wt. %) |
|---|---|
| polyvinyl alcohol LL 603 | 1.0 |
| water | 42 |
| SURFYNOL GA surfactant | 3 |
| 4,4-sulfonyldiphenol | 50 |

The foregoing composition is ground in an attrition mill or horizontal mill until the particles have an average particle size of about 1.7 to about 2.5 microns. Then the developer dispersion is combined to make the following mixture containing base ink and dye.

Combined Dye and Developer Dispersion Coating

| Ingredient | Parts by weight |
|---|---|
| AQ-103 grafted starch binder | 34 |
| water | 8 |
| Developer Dispersion (from above table) | 25 |
| REMYLINE AC 6 micron rice starch | 7 |
| HIDORIN D-523[6] | 5 |
| TINUVIN PST | 1 |
| IRGANOX 1010 | 1 |

-continued

Combined Dye and Developer Dispersion Coating

| Ingredient | Parts by weight |
|---|---|
| polyvinyl alcohol LL 603 | 1 |
| dye formula (selected from above tables) | 6 |

[6]HIDORIN D-523 commercially available from Cytech of Elizabethtown, Kentucky.

A coating containing the dye and developer is applied in a manner similar to the coating containing only the dye, but the foregoing combined dye and developer dispersion is sensitive to both solvent and abrasion.

A latent image coating may also be prepared with any of the above dye formulations in combination with a low melting point sensitizer, such as parabenzylbiphenol commercially available from Nagase America of New York, N.Y. A dye formulation containing parabenzylbiphenol may be developed by friction alone without the need for solvent. The low melting point sensitizer is preferably mixed with a dye formulation in an amount ranging from about 7 to about 14 percent by weight and typically has a melting point in the range of from about 70° to about 110° C.

It will be recognized that many other combinations of dyes may be used to produce various colors. Likewise, other organic dyes known by those skilled in the art may be used.

A wide variety of printing techniques may be used to print the latent image containing dye and/or developer on a substrate including spot printing and process printing. A particularly preferred printing technique is 3 or 4 color process printing. Process printing may be used with a web-offset or flexographic printer to deposit the latent image on the substrate. When developed, 3 or 4 color process printed images may be more visually pleasing than spot printing the images.

With reference again to FIG. 1, the imaging device 12 of the present invention is preferably a writing implement having a tubular body 14 for containing a solvent and a solvent dispensing tip 16. It is preferred that only an amount of solvent required to dissolve the organic-based dye 8 and organic-based color developer 10 particles in the printed layer be applied to the substrate with the imaging device 12. Too much solvent may soften or dissolve the substrate, and too little solvent will result in underdeveloped images.

A preferred imaging device 12 is a solvent pen having a felt solvent dispensing tip 16. The production of suitable felt tipped pens for dispensing solvents is well known in the art.

The solvent contained in the imaging device 12 is preferably an oxygenated solvent. Solvents suitable for use in the present invention include those which are soluble with, and hence, able to dissolve the organic-based dye 8 and the organic-based color developer 10. Examples of suitable solvents include but are not limited to $C_1$–$C_4$ alkyl alcohols, $C_1$–$C_4$ alkyl ethers, $C_1$–$C_4$ alkyl esters, ketones and acetates. A particularly preferred $C_1$–$C_4$ alkyl alcohol is ethanol, methanol or isopropanol. Preferred ketones include methyl ethyl ketone and acetone. A preferred acetate is ethyl acetate. The most preferred solvent is a denatured ethanol commercially available from Curtis Matheson, Inc. of Houston, Tex.

In alternative embodiments of the present invention the imaging device 12 of the present invention may contain an oxygenated solvent and either an organic-based dye 8 or an organic-based color developer 10. When the oxygenated solvent is combined with an organic-based dye 8 the amount of the organic-based dye 8 in the solvent may range from about 75 to about 99 wt. % oxygenated solvent and from about 1 to about 25 wt. % organic-based dye. A preferred amount of each is from about 80 wt. % oxygenated solvent and about 20 wt. % organic-based dye.

When it is desired to combine the oxygenated solvent with the organic-based color developer in the imaging device 12 the amount of each preferably ranges from about 75 to about 98 wt. % oxygenated solvent and from about 2 to about 25 wt. % organic-based color developer. A combination of developers and solvent may also be used. For example, the pen may contain from about 75 to about 98 wt. % ethanol, from about 1 to about 24 wt. % salicylic acid and from about 1 to about 24 wt. % 4,4-sulphonyldiphenol.

In addition to having all of the dye and developer printed on the substrate, or either the dye or developer dissolved in a solvent in the imaging device and the other component printed on the substrate, the invention also contemplates printing a substrate with a latent image containing both dye and developer particles and dissolving another portion of dye or developer in a suitable solvent for use in the imaging device. For example, the substrate may contain a layer of dye and developer particles as described above and the imaging device may contain from about 75 to about 100 wt. % solvent and from about 0 to about 25 wt. % developer or dye. Because the imaging device contains a solvent which is compatible with the organic dye and developer, it is preferred that the imaging device not contain both dye and developer.

Having described the invention and preferred embodiments thereof, it will be recognized that various combinations, rearrangements and substitutions may be made by those of ordinary skill in the art without departing from the spirit and scope of the claims.

What we claim is:

1. A method for developing a latent image on a substrate which comprises providing a dispersion of organic dye particles having an average particle size of from about 2 to about 6 microns and organic developer particles having an average particle size of from about 2 to about 6 microns in an aqueous carrier fluid, printing the dispersion on a substrate so that a substantially invisible image is produced and contacting the printed substrate in the portion of the printed latent image with an imaging device containing an oxygenated solvent to dissolve the dye particles and developer particles and cause reaction therebetween in order to develop a visible image on the substrate.

2. The method of claim 1 wherein the aqueous carrier fluid contains from about 5 to about 15 percent by weight organic dye particles and from about 6 to about 20 percent by weight organic developer particles.

3. The method of claim 1 wherein the developer particles are selected from a group consisting of phenolic resins, sulfone compounds, alkylhydroxybenzoic acid compounds, salicylic acid, salicylic acid metal salts and unsubstituted or ring-substituted phenols.

4. The method of claim 1 wherein the developer particles comprise 4,4-sulfonyldiphenol.

5. The method of claim 1 wherein the developer particles comprise from about 3 to about 25 wt. % salicylic acid.

6. The method of claim 1 wherein the substrate is selected from a group consisting of paper, plastic, metal, wood, natural or synthetic cloth, ceramic and glass.

7. The method of claim 1 wherein the oxygenated solvent is selected from a group consisting of $C_1$–$C_4$ alkyl alcohols, ketone, $C_1$–$C_4$ alkyl ethers, $C_1$–$C_4$ alkyl esters and acetates.

8. The method of claim 7 wherein the oxygenated solvent comprises ethanol.

9. The method of claim 1 wherein the dispersion is printed on the substrate using a 3 or 4 color process printing technique.

10. A method for developing an image on a substrate which comprises dispersing an organic dye having an average particle size of from about 2 to about 6 microns in an aqueous carrier fluid, depositing the dispersion on a substrate to provide a substantially invisible image thereon and contacting at least a portion of the substrate with a device containing an organic developer in an oxygenated solvent, the developer being present in an amount sufficient to develop a visible image on the substrate from the substantially invisible image thereon.

11. The method of claim 10 wherein the aqueous carrier fluid contains from about 5 to about 15 percent by weight of organic dye.

12. The method of claim 10 wherein the developer is selected from a group consisting phenolic resins, sulfone compounds, alkylhydroxybenzoic acid compounds, salicylic acid, salicylic acid metal salts and unsubstituted or ring-substituted phenols.

13. The method of claim 12 wherein the developer comprises 4,4-sulfonyldiphenol.

14. The method of claim 12 wherein the developer comprises from about 3 to about 25 wt. % salicylic acid.

15. The method of claim 10 wherein the oxygenated solvent contains from about 2 to about 25 wt. % organic-based developer.

16. The method of claim 10 wherein the substrate is selected from a group consisting of paper, plastic, metal, wood, natural or synthetic cloth, ceramic and glass.

17. The method of claim 10 wherein the oxygenated solvent is selected from a group consisting of $C_1$–$C_4$ alkyl alcohols, ketones, $C_1$–$C_4$ alkyl ethers, $C_1$–$C_4$ alkyl esters and acetates.

18. The method of claim 10 wherein the oxygenated solvent comprises ethanol.

19. The method of claim 10 wherein the aqueous carrier fluid further comprises from about 6 to about 20 percent by weight of organic developer particles having a particle size ranging from about 2 to about 6 microns.

20. The method of claim 10 wherein the dispersion is deposited on the substrate using a 3 or 4 color process printing technique.

21. A method for developing an image on a substrate which comprises dispersing an organic developer having an average particle size of from about 2 to about 6 microns in an aqueous carrier fluid, printing the dispersed developer on a substrate to provide a substantially invisible image and contacting at least a portion of the printed substrate containing developer particles with a device containing an organic dye in an oxygenated solvent, the dye being present in an amount sufficient to develop a visible image on the substrate.

22. The method of claim 21 wherein the aqueous carrier fluid contains from about 6 to about 20 percent by weight of the organic developer.

23. The method of claim 21 wherein the developer is selected from a group consisting of phenolic resins, sulfone compounds, alkylhydroxybenzoic acid compounds, salicylic acid, salicylic acid metal salts and unsubstituted or ring-substituted phenols.

24. The method of claim 23 wherein the developer comprises 4,4-sulfonyldiphenol.

25. The method of claim 23 wherein the developer comprises from about 3 to about 25 wt. % salicylic acid.

26. The method of claim 21 wherein the substrate is selected from a group consisting of paper, plastic, metal, wood, natural or synthetic cloth, ceramic and glass.

27. The method of claim 21 wherein the oxygenated solvent is selected from a group consisting of $C_1$–$C_4$ alkyl alcohols, ketone, $C_1$–$C_4$ alkyl ethers, $C_1$–$C_4$ alkyl esters and acetates.

28. The method of claim 27, wherein the solvent contains from about 2 to about 25 wt. % organic dye.

29. The method of claim 27 wherein the oxygenated solvent comprises ethanol.

30. The method of claim 21 wherein the aqueous carrier fluid further comprises from about 5 to about 15 percent by weight of organic dye particles having a particle size ranging from about 2 to about 6 microns.

31. The method of claim 21 wherein the dispersion is printed on the substrate using a 3 or 4 color process printing technique.

32. A novelty product consisting essentially of a substrate containing a layer of organic dye particles having an average particle size of from about 2 to about 6 microns and organic developer particles having average particle size of from about 2 to about 6 microns and an imaging device containing an oxygenated solvent for dissolving the developer particles and dye particles to cause reaction therebetween.

33. The novelty product of claim 32 wherein the developer is selected from a group consisting phenolic resins, sulfone compounds, alkylhydroxybenzoic acid compounds, salicylic acid, salicylic acid metal salts and unsubstituted or ring-substituted phenols.

34. The novelty product of claim 33 wherein the developer comprises from about 3 to about 25 wt. % salicylic acid.

35. The novelty product of claim 33 wherein the developer comprises 4,4-sulfonyldiphenol.

36. The novelty product of claim 32 wherein the substrate is selected from a group consisting of paper, plastic, metal, wood, natural or synthetic cloth, ceramic and glass.

37. The novelty product of claim 32 wherein the oxygenated solvent is selected from a group consisting of $C_1$–$C_4$ alkyl alcohols, ketones, $C_1$–$C_4$ alkyl ethers, $C_1$–$C_4$ alkyl esters and acetates.

38. The novelty product of claim 37 wherein the oxygenated solvent comprises ethanol.

39. The novelty product of claim 32 wherein the dye and developer particles are printed on the substrate using a 3 or 4 color process printing technique.

* * * * *

UNITED STATES PATENT AND TRADEMARK OFFICE

CERTIFICATE OF CORRECTION

PATENT NO. : 5,814,579

DATED : September 29, 1998

INVENTOR(S) : Dotson et al.

It is certified that error appears in the above-identified patent and that said Letters Patent is hereby corrected as shown below: ON THE TITLE PAGE:

Item [73] Assignee, after, "The Standard Register Company" insert --Part Interest--.

Column 8, line 8, after "D-523" insert --is a zinc stearate dispersion which is--.

Signed and Sealed this

Twenty-third Day of February, 1999

*Attest:*

Q. TODD DICKINSON

*Attesting Officer*

*Acting Commissioner of Patents and Trademarks*